US006058585A

United States Patent [19]

Soleymani

[11] Patent Number: 6,058,585

[45] Date of Patent: May 9, 2000

[54] CAMSTOPPER

[76] Inventor: Bahram Soleymani, 8071 Graziadio Dr. #3, Huntington Beach, Calif. 92646

[21] Appl. No.: 09/164,038

[22] Filed: Sep. 30, 1998

[51] Int. Cl.[7] ..... B25B 27/14

[52] U.S. Cl. ..... 29/281.6; 411/366

[58] Field of Search ..... 29/281.6, 238, 29/239; 269/242; 411/389

[56] References Cited

U.S. PATENT DOCUMENTS 5,755,029 5/1998 Learned .

OTHER PUBLICATIONS

"Timing Belts Domestic and Import Cars, Light Trucks and Vans 1974–1998, 1999 Ed."; Feb. 1999; pp. 104–107; Autodata Publications Inc., Hudson, MA, USA.

*Primary Examiner*—David A. Scherbel
*Assistant Examiner*—Daniel Shanley
*Attorney, Agent, or Firm*—Irell & Manella LLP

[57] ABSTRACT

A camshaft holding tool and a corresponding method for operation in a dual overhead camshaft engines is described. In one embodiment, the holding tool includes a double ended stud having a knob portion, and first and second threaded shafts that are threaded in opposite directions. The holding tool also includes first and second holding members defining apertures that are threaded in opposite directions to screwably receive the first and second threaded shafts;, respectively. The first and second holding members each includes a curved portion having one or more teeth for complementing camshaft sprockets. Each tooth of the first and second holding members is used for engaging adjacent teeth of respective camshaft sprockets.

14 Claims, 4 Drawing Sheets

Fig. 1
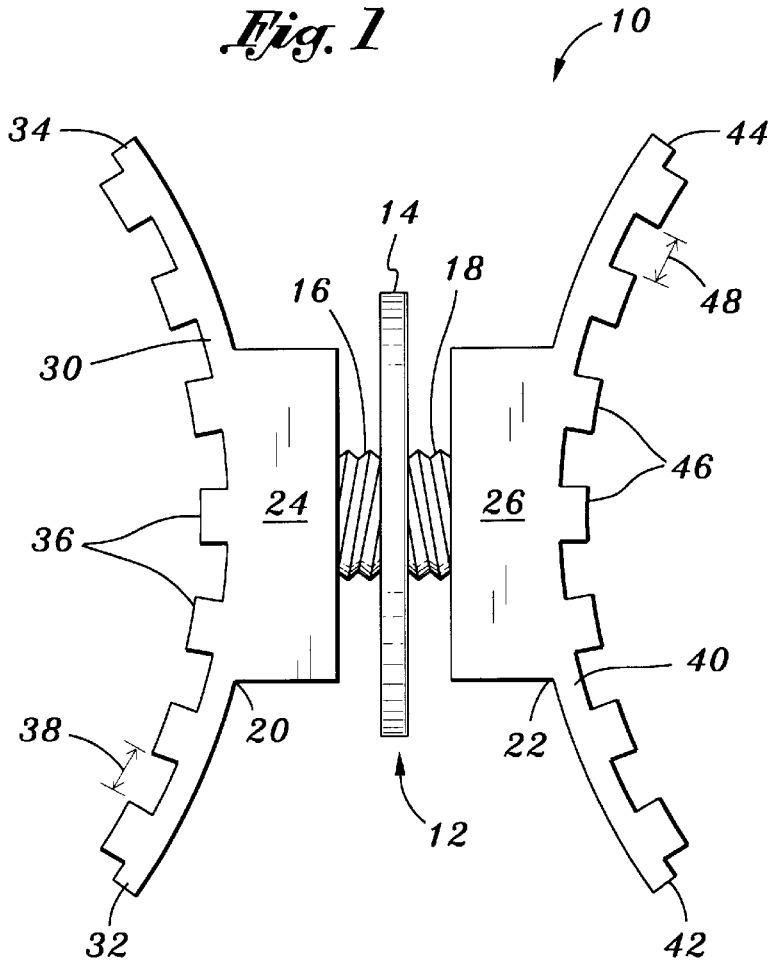
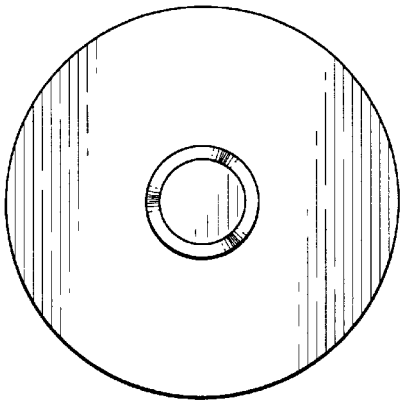
Fig. 2A
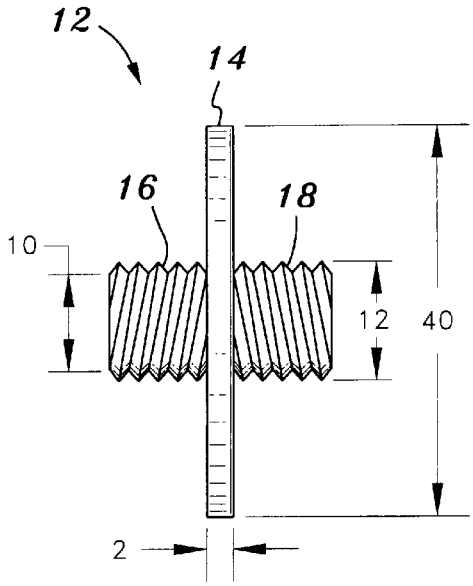
Fig. 2B

CAMSTOPPER

BACKGROUND OF THE INVENTION

1. Field of the Invention

The present invention relates generally to the field of tools for use with vehicle engines, and specifically, to tools used for use with double over head cam internal combustion engines.

2. Background Information

Replacing a timing belt on dual overhead camshafts internal combustion engines is not an easy task. When the timing belt is removed from the camshaft sprockets, the camshaft sprockets rotate due to the pressure induced by the valve springs. When installing a new (or the same) timing belt, the camshaft sprockets must be positioned in fixed timing relation to each other (e.g., top (lead center). This requires an automotive technician, with difficulty, to position both sprockets in timing relation to each other against the force of the valve springs, while installing the timing belt. Often, the assistance of another automotive technician or person is required to install the timing belt. If the camshaft sprockets are not in fixed timing relation to each other when the timing belt is installed, the engine will show detrimental symptoms. These include engine misfire, hasty acceleration, idle problems, high emissions, and, in some extreme cases, internal engine or valve train damage. This problem is even worse in V6 and V8 dual overhead camshaft engines.

SUMMARY OF THE INVENTION

The present invention comprises a camshaft holding tool and corresponding method for operating the camshaft holding tool in double overhead camshaft engines. In one embodiment, the holding tool includes a double ended stud having a knob portion, and first and second threaded shafts that are threaded in opposite directions. The holding tool also includes first and second holding members defining apertures that are threaded in opposite directions to screwably receive the first and second threaded shafts, respectively. The first and second holding members each includes a curved portion having one or more teeth. Each tooth of the first and second holding members is used for engaging adjacent teeth of a respective one of first and second camshaft sprockets.

Other embodiments are claimed and described herein.

BRIEF DESCRIPTION OF THE DRAWINGS

FIG. 1 shows a side view of a camshaft holding tool for use with a dual overhead camshaft engine, according to one embodiment of the present invention.

FIGS. 2A and 2B show views of the double ended stud of FIG. 1 with exemplary dimensions, according to one embodiment of the present invention.

DETAILED DESCRIPTION

Figure 3A:
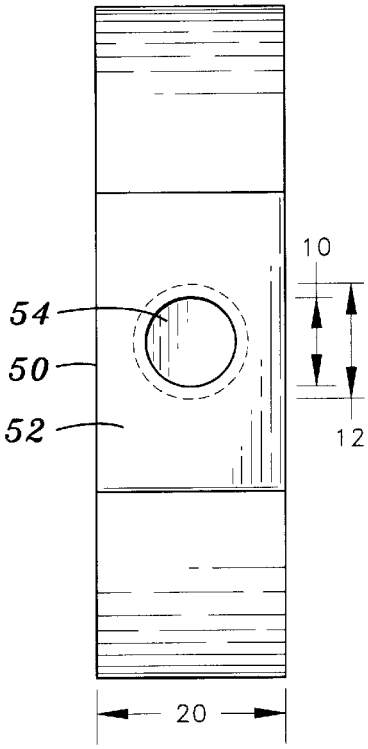
FIGS. 3A through 3D show various views of a holding member of FIG. 1 with exemplary dimensions, according to one embodiment of the present invention.

The present invention comprises a camshaft holding tool and method for operating the camshaft holding tool in double overhead camshaft engines. In one embodiment, the holding tool includes a double ended stud having a knob portion, and first and second threaded shafts that are threaded in opposite directions. The holding tool also includes first and second holding members defining apertures that are threaded in opposite directions to screwably receive the first and second threaded shafts, respectively, of the double ended stud. The first and second holding members each includes a curved portion having one or more teeth. Each tooth of the first and second holding members is used for engaging adjacent teeth of a respective one of first and second camshaft sprockets.

FIG. 1 shows a diagram of a side view of a camshaft holding tool 10 for use with a dual overhead camshaft engine, according to one embodiment of the present invention. The camshaft holding tool 10 is directed at holding the camshaft sprockets in fixed relation to each other (e.g., top dead center) in a dual overhead camshaft internal combustion engine when a timing belt is removed.

Referring to FIG. 1, the camshaft holding tool 10 includes double ended stud (or knob) 12, and first and second holding (or engagement) members 20 and 22. The double ended stud 12 includes a knob portion 14 and first and second threaded shafts 16 and 18 which are threaded in opposite directions (a right-handed thread and a left-handed thread). The threaded shafts 16 and 18 are formed coaxially and integral with the knob portion 14. The knob portion 14 extends perpendicular to the axis of the threaded shafts 16 and 18.

The first holding member 20 includes a base portion 24 and a curved portion 30 forming an arc from a first end 32 to a second end 34. The curved portion 30 includes a plurality of teeth (or cogs) 36 spaced apart from each other by a distance 38. Similarly, the second holding member 22 includes a base portion 26 and a curved portion 40 forming an arc from a first end 42 to a second end 44 of the curved portion 40. The curved portion 40 includes a plurality of teeth 46 spaced apart from each other by a distance 48. The curved portions 30 and 40 are complementary with corresponding camshaft sprockets (or cog wheels) such that each tooth of curved portions 30 and 40 engage adjacent teeth of a respective camshaft sprocket of a dual overhead camshaft engine (see FIG. 5).

The first holding member 20 forms a cavity (see FIG. 3A) that is threaded in one direction (e.g., right-handed), while the second holding member 22 forms a cavity that is threaded in an opposite direction (left-handed). The cavities formed in the first and second holding members 20 and 22 screwably receive the threaded shafts 16 and 18 of the double-ended stud 12 (the right-hand threaded cavity screwably receives the right-hand threaded shaft and the left-hand threaded cavity screwably receives the left-hand threaded shaft). Thus, when the knob portion 14 is rotated in one direction, the threaded shafts 16 and 18 both screw into the threaded cavities of respective first and second holding members 20 and 22. This causes the first and second holding members 20 and 22 to move toward each other. When the knob portion 14 is rotated in an opposite direction, the threaded shafts 16 and 18 unscrew from the threaded cavities of the respective first and second holding members 20 and 22, causing the first and second holding members 20 and 22 to move away from each other.

FIGS. 2A and 2B show views of the double ended stud 12 of FIG. 1, according to one embodiment of the present invention. FIGS. 2A and 2B also show exemplary dimensions of the double ended stud 12 where all dimensions are provided in millimeters. However, it is important to note that the dimensions may vary.

In particular, FIG. 2A shows a front (or back) view of the double ended stud 12, while FIG. 2B shows a side view of the double ended stud 12. As shown in FIG. 2B, shafts 16 and 18 have helical threads formed in opposite directions. The diameter of shafts 16 and 18 is 10 millimeters while the threaded diameter is 12 millimeters. The diameter of the knob portion 14 is 40 millimeters and its thickness is 2 millimeters.

FIGS. 3A through 3D show various views of a holding member, designated as numeral 50, according to one embodiment of the present invention. The dimensions are provided in millimeters.

Referring to FIG. 3A, a back-view of the holding member 50 is shown. As shown therein, a threaded cavity 54 (or aperture) is formed in the base portion 52 of the holding member 50 to receive one of the threaded shafts 16 and 18 of the double ended stud 12 (FIG. 1). Note that the camshaft holding tool 10 of the present invention (as shown in FIG. 1) includes two holding members having cavities that are threaded in opposite directions. Thus, one holding member has a cavity that is threaded in one direction, while the other holding member has a cavity that is threaded in an opposite direction. The internal diameter of the cavity 52 is 10 millimeters and the threaded diameter is 12 millimeters. The width of the holding member 50 is 20 millimeters.

Figure 3B:
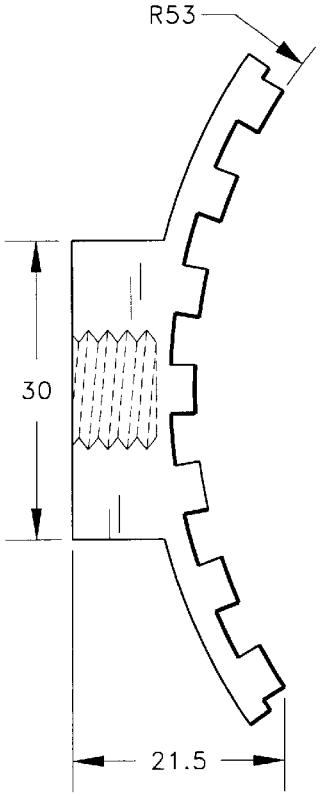
Figure 3C:
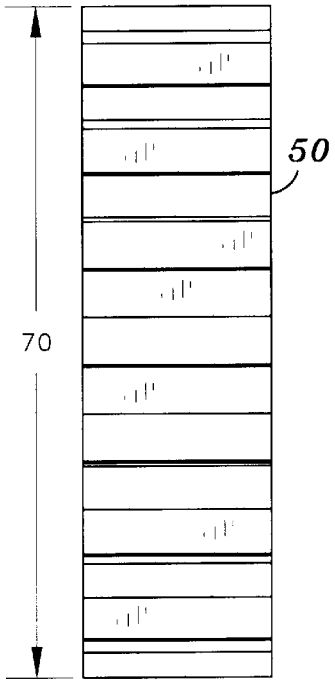
Figure 3D:
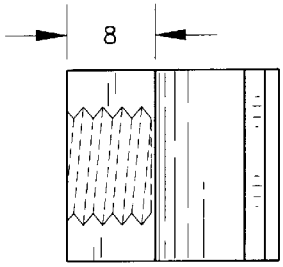

FIG. 3B illustrates a side-view of the holding member 50. As shown therein, the length of the base portion 52 is 30 millimeters and the width of the holding member 50 is 21.5 millimeters. FIG. 3C illustrates a front view of the holding member 50 showing the teeth. The height of the holding member 50 is 70 millimeters. FIG. 3D shows a top view of the holding member 50. The depth of the threaded cavity 54 is 8 millimeters.

It is to be noted that the dimensions provided in FIGS. 2A and 2B and 3A through 3D are dimensions according to one embodiment. However, the dimensions may vary without departing from the spirit and scope of the present invention. For example, the dimensions may vary depending on the size of the camshaft sprockets, the spacing between adjacent cogs, the distance between the camshaft sprockets, etc.

Figure 4:
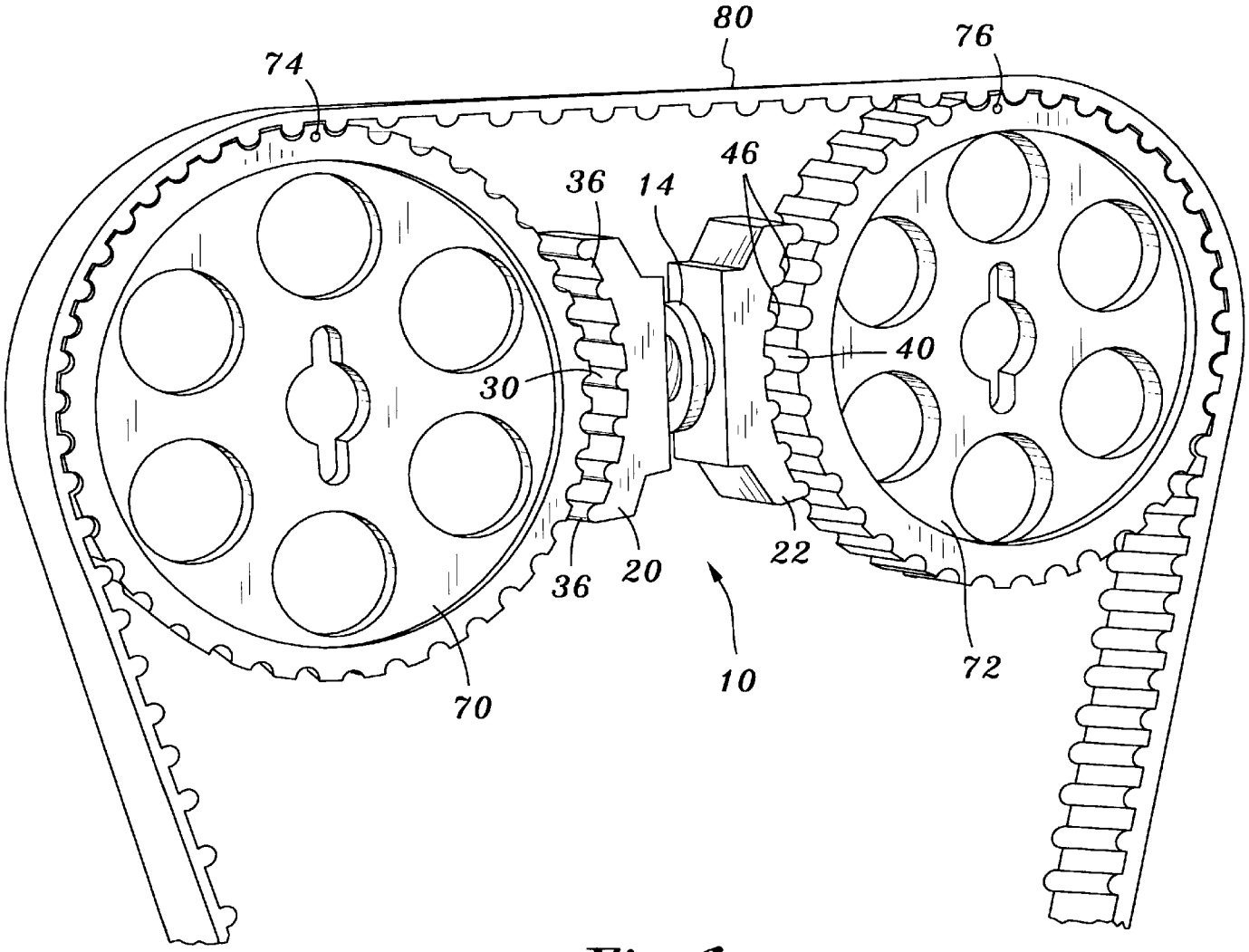
FIG. 4 shows a perspective view of the camshaft holding tool for engaging camshaft sprockets of a dual overhead camshaft engine.

FIG. 4 shows a perspective view of the camshaft holding tool 10 for engaging camshaft sprockets 70 and 72. A method of engaging camshaft sprockets 70 and 72 in order to remove the timing belt will now be described. Optionally, the camshaft sprockets 70 and 72 may be oriented in a desired position (e.g., top dead center, as shown by timing marks 74 and 76). Then, the camshaft holding tool 10 in positioned between camshaft sprockets 70 and 72, as shown. If the camshaft holding tool 10 does not fit in the space between camshaft sprockets 70 and 72, then the knob portion 14 is rotated in a first direction in order to move the first and second holding members 20 and 22 closer to each other. Once the camshaft holding tool 10 fits in between the camshaft sprockets 70 and 72, the knob portion 14 is rotated in a second, opposite direction to move the first and second holding members 20 and 22 away from each other. The knob portion 14 is rotated in the second direction until each tooth of the curved portions 30 and 40 engage adjacent cogs ol the camshaft sprockets 70 and 72 snuggly. The timing belt 80 is then removed, a, the camshaft holding tool 10 holds the camshaft sprockets 70 and 72 in place.

Figure 5:
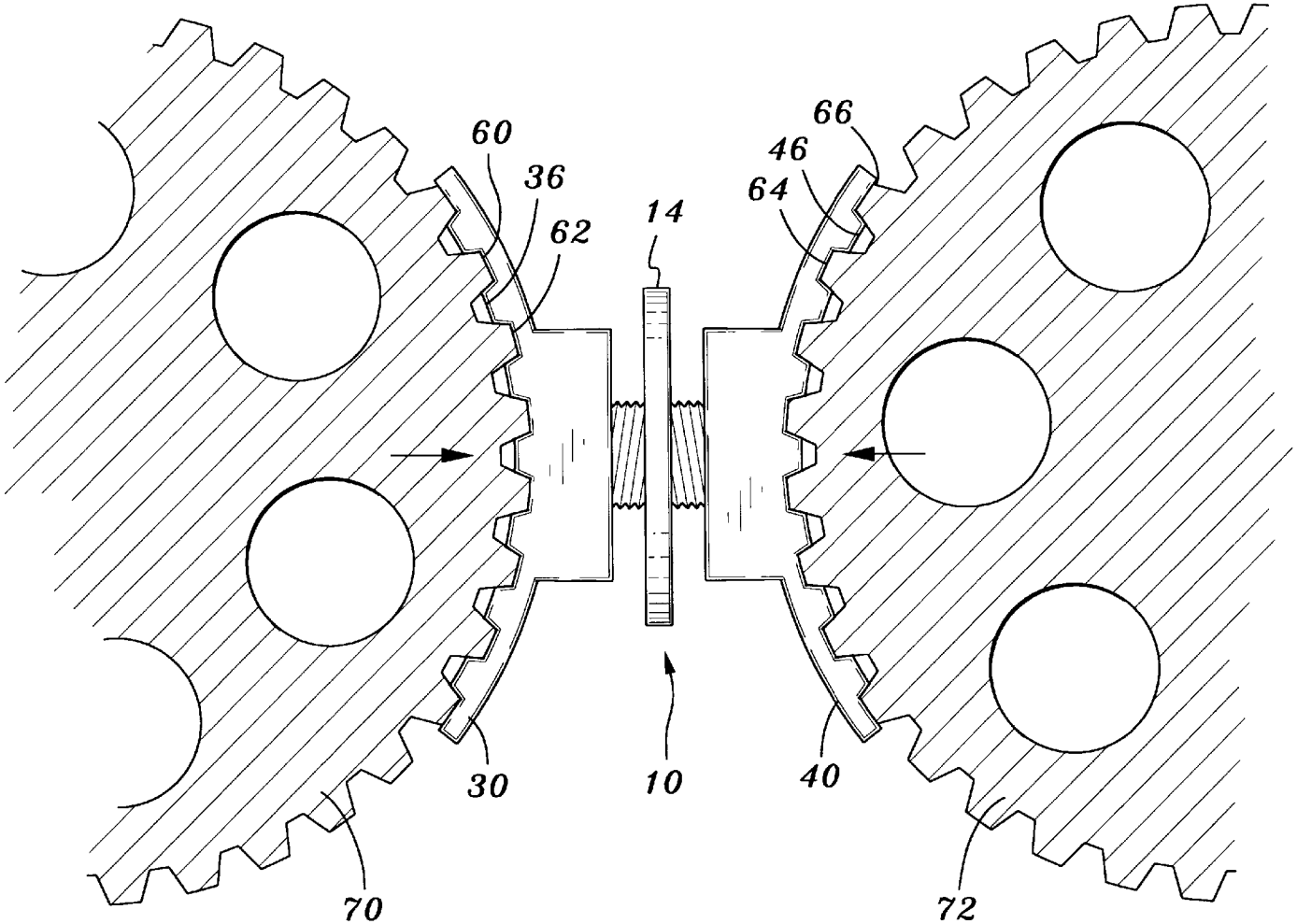
FIG. 5 shows a side view of the camshaft holding tool engaging camshaft sprockets.

FIG. 5 shows a side view of the camshaft holding tool 10 engaging camshaft sprockets 70 and 72 of a dual overhead cam engine. As shown in FIG. 5, the tool 10 is engaged such that each tooth 36 of the curved portion 30 engages adjacent cogs 60 and 62 of the camshaft sprocket 70 and each tooth 46 of the curved portion 40 engages adjacent cogs 64 and 66 of the camshaft sprocket 72. In this position, the camshaft holding tool 10 prevents the camshaft sprockets 70 and 72 from rotating and holds the sprockets in fixed relation to each other (e.g., top dead center, as is known in the art).

Referring back to FIG. 4, once the timing belt 80 (or a new timing belt) is placed back on the camshaft sprockets 70 and 72, the knob portion 14 of the camshaft holding tool 10 is again rotated in the first direction to move the holding members 20 and 22 closer together and disengage from the camshaft sprockets 70 and 72, respectively.

As can be seen, the present invention describes a camshaft holding tool that is used for holding camshaft sprockets of a dual overhead camshaft engine in place while the timing belt is removed. The tool is adjustable, providing flexibility for engaging camshaft sprockets. Additionally, the tool is very easy to use, making a mechanics job much easier in changing the timing belt or performing other repairs that require the timing belt to be removed. In the case of V6, V8, and V12 engines, two camshaft holding tools are used, one for each cylinder bank.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An article of manufacture, comprising:

a double ended stud including, a knob portion, a first threaded shaft threaded in one direction, and a second threaded shaft threaded in an opposite direction; and first and second holding members defining apertures that are threaded in opposite directions to screwably receive the first and second threaded shafts of the double ended stud, said first and second holding members each including a curved portion having one or more teeth, each tooth of the first and second holding members for engaging adjacent teeth of a respective one of first and second camshaft sprockets.

2. The article of manufacture of claim 1 wherein the knob portion, and the first and second threaded shafts of the double ended stud form a single moving member.

3. The article of manufacture of claim 2 wherein the curved portions of the first and second holding members are substantially complementary with the first and second camshaft sprockets, respectively.

4. The article of manufacture of claim 2 wherein when the knob portion is rotated in one direction, the first and second holding members move axially away from the knob portion.

5. The article of manufacture of claim 4 wherein when the knob portion is rotated in an opposite direction, the first and second holding members move axially toward the knob portion.

6. The article of manufacture of claim 2 wherein when the knob portion is rotated in one direction, the first and second threaded shafts screw into the apertures of the first and second holding members, respectively, to move the first and second holding members toward each other.

7. The article of manufacture of claim 6 wherein when the knob portion is rotated in an opposite direction, the first and second threaded shafts unscrew from the apertures of the first and second holding members, respectively, to move the first and second holding members away from each other.

8. A double overhead camshaft engagement tool, comprising:

a double ended stud including a knob portion, and first and second threaded shafts threaded in opposite directions; and first and second holding members defining apertures that are threaded in opposite directions to screwably receive the corresponding first and second threaded shafts of the double ended stud, said first and second holding members each including a curved portion having one or more teeth of the one or more teeth.

9. The double overhead camshaft engagement tool of claim 8 wherein the knob portion, and the first and second threaded shafts of the double ended stud form a single moving member.

10. The double overhead camshaft engagement tool of claim 9 wherein the curved portions of the first and second holding members are substantially complementary with the respective camshaft sprockets.

11. The double overhead camshaft engagement tool of claim 9 wherein when the knob portion is rotated in one direction, the first and second holding members move axially away from the knob portion.

12. The double overhead camshaft engagement tool of claim 11 wherein when the knob portion is rotated in an opposite direction, the first and second holding members move axially toward the knob portion.

13. The double overhead camshaft engagement tool of claim 9 wherein when the knob portion is rotated in one direction, the first and second threaded shafts screw into the apertures of the first and second holding members, respectively, to move the first and second holding members toward each other.

14. The double overhead camshaft engagement tool of claim 13 wherein when the knob portion is rotated in an opposite direction, the first and second threaded shafts unscrew from the apertures of the first and second holding members, respectively, to move the first and second holding members away from each other.

* * * * *

UNITED STATES PATENT AND TRADEMARK OFFICE

CERTIFICATE OF CORRECTION

PATENT NO. : 6,058,585
DATED : May 9, 2000
INVENTOR(S) : Bahram Soleymani

It is certified that error appears in the above-identified patent and that said Letters Patent is hereby corrected as shown below:

Abstract,
Line 8, after "shafts", please delete ";".

Column 1,
Line 17, after "top", please delete "(lead", and insert in lieu thereof -- dead --.

Column 2,
Line 20, after "includes", please insert -- a --.

Column 3,
Line 59, after "cogs", please delete "ol", and insert in lieu thereof -- of --.
Line 61, after "removed,", please delete "a,", and insert in lieu thereof -- as --.

Column 4,
Line 17, after "a", please delete "mechanics", and insert in lieu thereof
-- mechanic's --.

Column 5, claim 8,
Line 11, after "teeth", please delete "of the one or more teeth.", and insert in lieu thereof --, wherein each of the one or more teeth of the first and second holding members for engaging adjacent teeth of a respective one of first and second camshaft sprockets. --

Signed and Sealed this

Ninth Day of October, 2001

*Attest:*

Nicholas P. Godici

*Attesting Officer*

NICHOLAS P. GODICI
*Acting Director of the United States Patent and Trademark Office*